United States Patent [19]

Munroe

[11] Patent Number: 4,779,751

[45] Date of Patent: Oct. 25, 1988

[54] KNOCK-DOWN CONTAINERS, CONTAINER FASTENING SYSTEM AND ELEMENTS THEREOF

[76] Inventor: Thomas Munroe, 4305 Delco-Dell Rd., Dayton, Ohio 45429

[21] Appl. No.: 34,953

[22] Filed: Apr. 6, 1987

[51] Int. Cl.[4] ..... A44B 21/00

[52] U.S. Cl. ..... 217/69; 220/1.5

[58] Field of Search ..... 217/69, 43 A, 45, 12 R; 220/1.5, 73, 76, 69, 70; 206/509, 511, 512; 229/49

[56] References Cited

U.S. PATENT DOCUMENTS

| | | | |
|---|---|---|---|
| 1,656,161 | 1/1928 | Berndt | 217/69 |
| 2,168,911 | 8/1939 | Meyer | 217/69 |
| 2,549,509 | 4/1951 | Munroe | 217/69 X |
| 3,599,822 | 8/1971 | Johnson . | |
| 3,760,465 | 9/1973 | Brennan | 229/49 X |
| 4,015,714 | 4/1977 | Silver et al. | 206/511 |
| 4,083,464 | 4/1978 | Burnett | 217/69 X |
| 4,139,113 | 2/1979 | Graham, Jr. . | |
| 4,453,471 | 6/1984 | Harrington et al. . | |
| 4,618,068 | 10/1986 | Born | 220/1.5 X |
| 4,662,532 | 5/1987 | Anderson et al. | 220/1.5 X |

OTHER PUBLICATIONS

APA 300 Gallon Bin Specification, American Plywood Association, Jan. 1983.

Pallet Bins and Tanks, APA Industrial Use Guide, Form Y205E/Rev. Nov. 1984.

*Primary Examiner*—Steven M. Pollard

*Attorney, Agent, or Firm*—Biebel, French & Nauman

[57] ABSTRACT

A security container or pallet bin which may be knocked down or quickly erected, includes corner connectors for securing the intersecting side and end walls together. The corner connectors are sheet metal with first and second angled, generally planar legs which abut the adjacent intersecting outer surfaces of the intersecting walls which are jointed to each other along a common corner. The legs of the connector have transversely extending tabs which engage the adjacent upper surface of one of the walls to define the seated position of the connector, and each leg teminates in a flange which extends normal to the associated leg, but which is tapered or inclined with respect to the common corner so that the connector is wider at the bottom than at the top. The flange is received in an accommodating slot formed or cut in the walls so that when the connector is inserted the walls are caused to be cammed or urged together into a tightening relationship. Additional connectors are disclosed by which wall panels may be stacked one on the other to build up bins or containers of varying height and/or support intersecting walls or partitions. Corner and edge protectors are disclosed by which the completed bin is protected from damage. Further, the bin is provided with footer and footer locators on the respective bottom and top panels to permit stacking and to permit eight-way entry for fork-lift trucks.

15 Claims, 5 Drawing Sheets

KNOCK-DOWN CONTAINERS, CONTAINER FASTENING SYSTEM AND ELEMENTS THEREOF

BACKGROUND OF THE INVENTION

This invention relates to knock-down security containers, and more particularly to such a container and connectors by which the walls of the container are secured and retained.

There exists a need for low-cost storage and shipping bins and containers which are reasonably secure against tampering, such as for the storage and transport of high value merchandise or hazardous materials, and for personal long-term storage of possessions. A need exists for reliable hardware by which knocked-down containers may be easily and swiftly erected, filled and thereafter securely closed. Once so closed, it is desirable that such containers be readily openable only by authorized persons, so that any attempt at tampering can be recognizable. It is also desirable that the container components be easy to make at modest cost, and that the containers employing such components be easy to erect from common box or container materials, such as plywood or the like, without the necessity of making or using elaborate jigs or fixtures.

High security containers or containers made of rigid components which may be assembled at the site, often lack versatility in that the components will make up only a single container or a container of a single size. A need exists for a container or bin system of fasteners and connectors by which a plurality of containers of differing heights or widths can be made up from a single set of components.

Also, there is believed to be a need for personal storage containers which may be left for long term storage in a warehouse, which will occupy a minimum of space, which are adapted for modular storage concepts, and which afford a high degree of security to the user. Military arsonals requre easy-to-erect strong and secure containers for artillery shells. Shippers of valuable merchandise also require secure containers which are shippable in a knock-down state until filling.

It is further desirable in many instances to provide a shipping container which may be loaded from a side or an end and thereafter closed by insertion of the side or end panel and retained by security corner clips. It is often further desirable to provide a container, such as a knock-down container, in which either the side or end walls are wider or of heavier construction than the mating walls, and a corner security clip arrangement for securing such walls in assembled condition.

It is further desirable to provide a security container which is particularly adapted for modular construction, and in which individual modules may be stacked one on the other, and moved by a conventional forklift. Further, it is desirable to provide low cost security containers in which attempts at access to the contents will be readily apparent from observing the condition of the container or the seals, and in which the margins, such as the horizontal and vertical edges, are protected against intrusion.

There is a further need to provide a shipping bin or container which eliminates the need for the conventional wooden pallet or wooden pallet bin. The use of wooden pallets is on the decline, particularly in industries, such as the automotive industry, where the trend has been away from the pallet and toward the use of dedicated shipping containers. The wooden pallet does not offer an opportunity for an integrated design of an interlocking shipping unit and has resulted in much waste and lost due to the chances of poorly loaded pallets or mismatched arrangements of boxes stacked on pallets. Further, the wooden pallet has offered no ability to securely lock the load on the pallet or prevent shifting of the load with resulting pallet damage. Further, wooden pallets have the problems of nails popping out and boards splintering, and palletized shipping does not offer guards against vandalism or pilfering. The conventional wooden pallet bin, that is a bin or container having an integral bottom pallet, also lacks versatility in that the wooden stringers restrict multiple entry for fork lift manipulation, the corners and edges are generally unprotected from damage, and conventional fasteners are commonly used which are often inadequate.

SUMMARY OF THE INVENTION

This invention relates to a system of secure containers, and more particularly, to such a container system and to the connector elements by which the containers are secured, and which are easy to use, low in cost, and which are resistant to tampering.

Principal elements of the system include corner connectors made of sheet metal, such as hardened steel or the like, by which the intersecting walls of the container, at the corners or at the intersecting walls, are securely retained.

The corner connectors preferably have tabs which engage adjacent tops of the intersecting walls for positively locating the connectors on the walls. The connectors also have edge flanges which are self-locking with respect to the container walls, in that the flanges are received in tapered slots extending in the walls. Such flanges and the corresponding slots are formed at an inclination or slope with respect to the corner, so that the connector is somewhat wider at the bottom than at the top, and when inserted, forces the walls together at the corner. While the connector may form a 90° corner, it may also be formed at varying angles, such as 60° or 135°, for a container of less than or more than four sides.

The corner connectors of this invention may be formed with apertures placed so as to receive a locking element. Where that element is a nail, it may be received in a recessed opening, and protected from extraction. Where desired, a duplex nail may be used for easier extraction. A somewhat larger opening may be provided to receive a tumbler cylinder lock which requires extraction before the container may be opened. Vertical angle straps or corner protectors may be extended along the exposed corners of the container, with the ends thereof captured in corner connectors, for further security.

The container system of this invention also lends itself to the erection of containers which may be secured by convention encircling metal straps. The containers may be modular to conserve storage space, and may be handled by conventional forklift equipment.

The container system of this invention is further adapted for use as a pallet bin, as the term is understood in the container industry and as described in the American Plywood Association pamphlet "Pallet Bins and Tanks", Form Y205E-1972, revised November 1984. Pallet bins, made primarily or exclusively of wood, including plywood, have become the mainstay of many successful material handling systems. Such pallet bins consist of a container with an integral pallet, as the floor or deck panel of the container. Pallet bins are made in a wide variety of sizes and load carrying capabilities in accordance with the material to be carried and the common carrier on which the pallet bin is to be shipped, such as a truck van or a freight car.

Generally, the deck to permit only two-way or four-way entry, due to stringer locations. The pallet design may be dictated by the material to be carried, such as agricultural products, solid materials, and granular or bulk materials. Cooling, ventilating, and drainage can also be a problem. Such containers or bins are commonly stacked as high as 24 feet, thus imposing loads up to 12,000 pounds or more on the bottom bin.

The container system of this invention is particularly adapted for use as a demountable pallet bin of exceptional strength, and ease of assembly due to the use of standardized corner connectors, in combination with edge protectors as desired. Due to the design of the corner connectors, the container or bin is self-tightening as it is loaded, and the tightening is against the load on the interior of the container. When stacked, no weight is transferred to the interior or to the contents of a lower container or supporting bin. Due to the nature of the connector, the contents are protected from intrusion of dirt from the outside, due to the self-closing nature of the connectors.

In the knock-down version, the container is ideally suited for shipping in a knock-down state. When the container is wider than it is high or tall, the four panels which make up the container sides, and the container top, may be loaded onto and strapped to the deck panel.

The tops of the containers may be provided with half-pallet locating blocks, while the bottoms are provided with full hollow block engaging footers which are received over the top of the locating blocks, to lock an upper container in position with respect to a lower container, while providing a space between the blocks permitting eight-way entry for conventional forklifts. The pallet locating footers may be formed of steel tubing or high strength plastic material to resist impact damage by lifting forks, and the locating blocks may be made of wood.

A further advantage of the system resides in the fact that the connectors may be configured to secure and retain intersecting walls of differing thicknesses. This has particular advantage where one wall must be heavier than another wall. One example is that of the end walls of 155 mm artillery shell cases which are thicker and heavier than the side walls. Thus, the ends may be $\frac{3}{4}''$ material while the sides are $\frac{3}{8}''$ thick.

The box or shipping container system of this invention is not limited to one in which merely the top is removable. Rather, the top may be secured and one of the end or side walls removed for side loading installations. The connectors permit an arrangement by which a side wall may be removed for loading and thereafter inserted. The connectors may also be used to secure interior partitions to the end or side walls.

The connector elements of this invention may be advantageously used to join together panel sections in the making up of multiple side containers, such as containers having five or six sides or more, and for securely retaining these sides in an assembled or predetermined arrangement. Thus, very large containers can be made up using plywood sides of smaller dimensions, and quickly and easily erected on site. Further, personnel protection devices or "pup tents" may be made of rigid material and joined together in assembled relation using the components of this invention.

It is accordingly an important object of the invention to provide a corner connector for a knock-down container, and a container system employing a series of such connectors, in which generally L-shaped connection lockingly receive the intersecting walls of the container. Preferably, the connectors extend across the terminal ends of each wall and may provide an opening through which a keeping or locking member may be inserted or driven. The connectors may be made of steel and hardened for security.

A further object of the invention is the provision of a corner connector for a knock-down container which is self holding and self-locking when assembled with the container walls, and which is provided with elements for engaging, locating and locking the container top in relation to the side walls.

Another object and advantage of the invention is the fact that the corner connectors thereof are of relatively low cost and are easy to fabricate, and require a minimum of modification to the container walls to accommodate the connectors.

An object of the invention is to provide versatility in securing a container for shipment or long-term storage. In a simpler form of the invention, conventional steel straps may be used to encircle the side walls top and bottom and locked or sealed in place. However, where desired, the side walls and/or tops and bottoms may be secured by one or more fastening elements driven through suitable apertures to openings formed in the corner clips with the heads countersunk to thwart tampering or removal. Alternatively, a lock arrangement may be provided by which the connector may be secured in place and removed when it is desired to enter the container.

A particular advantage of the container system of this invention is the provision of connectors by which side walls of differing heights may be selected or may be stacked one on the other, to provide versatility in the build-up of a container from standard width panels. Three sizes of base panels and three sizes of wall panels, permits the selection of twenty-four different container sizes.

Another object of the invention is to provide a container system incorporating or utilizing corner connectors, as outlined above, which grip the intersecting walls of a container corner, and cause them to be pressed together at the corner.

A further object of the invention is the provision of a knock-down container system in which the containers may be conveniently loaded or filled from an end or from the top, as desired.

A still further object of the invention is the provision of a container system and a corner securing connector for the same, in which the end wall or the side walls may be heavier or of thicker construction than the intersecting wall, and in which the walls may be supported at angles other than at 90°.

These and other objects and advantages of the invention will be apparent from the following description, the accompanying drawings, and the appended claims.

DESCRIPTION OF THE PREFERRED EMBODIMENTS

Figure 1:
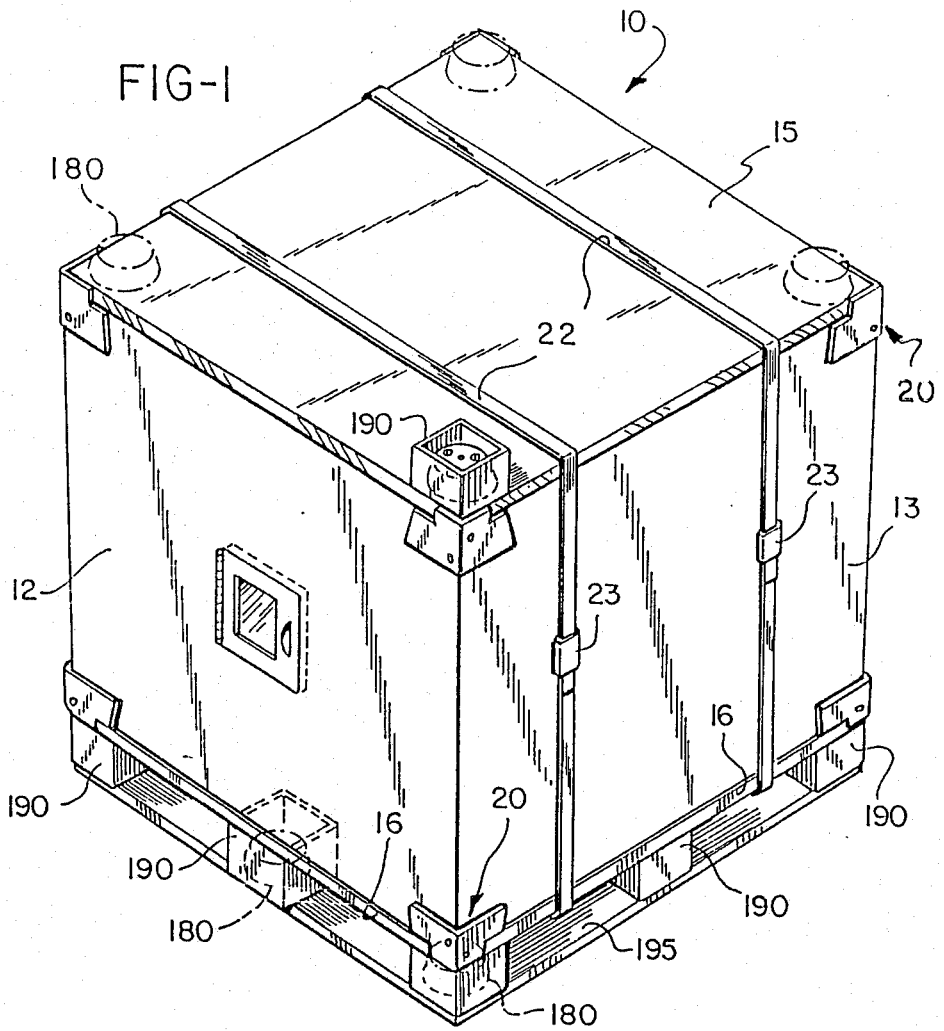
FIG. 1 is a perspective view of a pallet bin constructed according to this invention.
Figure 2:
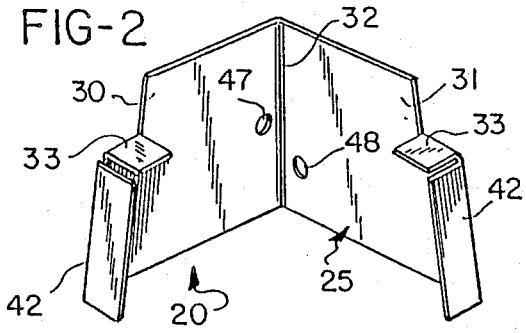
FIG. 2 is a perspective view of the outer member of one of the corner connectors.

FIG. 1 illustrates a security knock-down container 10 for long-term storge or shipping, made in the form of a pallet bin. The container has four side walls, walls 12 and 13 being shown, a top or top wall 15, and a deck or a bottom panel 16. Wall 12 may be provided with a shipping document storage compartment closed by a door 14. The walls are joined at the corners by sheet metal connectors 20 made in accordance with one embodiment of this invention, as best shown in FIG. 2. The container 10 may be closed by a pair of encircling metal straps 22. Straps 22 may be provided with a lock which can only be opened by a person having proper access to the container, or sealed with tamper-proof Scotch Brand sealing tape 23, sold under the trade name "Secure-A-Seal". One of the panels may incorporate a shipping document access window 24.

Figure 3:
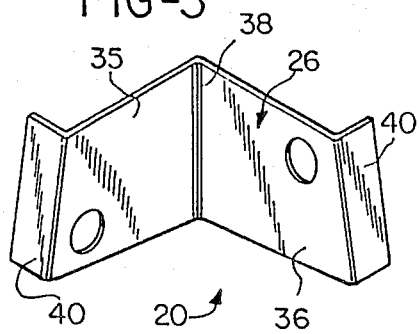
FIG. 3 is a perspective view of an optional inner member of one of the corner connectors used cooperatively with an outer member of FIG. 2.

The corner connector 20, as illustrated at FIGS. 2 and 3, is made of sheet steel, such as 14 gauge steel, which may be surface hardened for security. The connector 20 includes an outer member 25 shown in FIG. 2 and may optionally include an inner member 26 shown in FIG. 3. When the inner member is used, the members are joined together as by welding to form a unitary corner backet, to locate and retain the intersecting end and side walls of the container 10. When the connector includes both inner and outer members, a lighter weight steel such as 18 gauge may be used.

Referring to the outer connector member 25 shown in FIG. 2, it is formed with first and second planar leg sections 30 and 31, bent at an angle to each other to form a common outer corner 32. The outer member 25 may be considered as having generally planar legs or sections which are proportioned to abut against the adjacent outer surfaces of a pair of intersecting side walls.

Each leg section 30 and 31 of an outer member is formed, at its upper edge, with an inwardly directed tab 33, proportioned to be received against the top surface of one of the intersecting side or end walls. A shallow notch 33*a* may be cut in the wall to receive and recess the tabs 33, if desired.

The connector 25, as shown in FIG. 2, is further provided with a pair of transversely inwardly directed flanges 34. These flanges are formed generally normal to the planar leg sections 31 and 32, but the planar sections are wider at the bottom than at the top, to provide flanges 34 which are inclined to the vertical, such as for example, 7°, so that the connector is somewhat wider at the bottom than it is at the top. The flanges 34 have a height, in the direction normal to the planar leg sections 30 and 31, which does not exceed the thickness of one of the container side walls 12 or 13.

Figure 4:
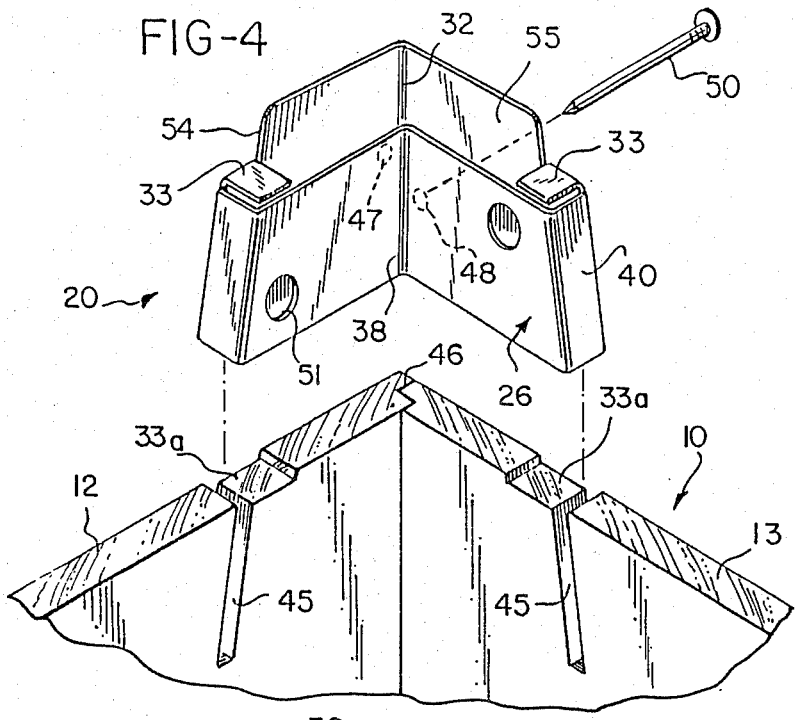
FIG. 4 is a perspective view showing the relationship of the assembled corner connector of FIGS. 2 and 3 and the intersecting side walls or panels of the container prior to assembly.

The optional iner member 26, as shown in FIG. 3, also is formed with generally planar leg sections 35 and 36 bent at an angle to form an inside corner 38. The ends of the planar leg sections may be formed as outwardly turned flanges 40 which are proportioned to abut against an inside surface of the outer member 25 just inwardly of the outer edge 42 (FIG. 2) and welded to the outer member to form a unitary connector, as shown in FIG. 4.

The flanges 40 are also provided with a cant or inclination with respect to the vertical. The length of the flanges 34 and 40 serve to define the spacing between the inside and outside members, so that they form a snug or close fit with each of the intersecting side walls when the flanges are received in suitable corresponding tapered cuts 45 formed in the side walls 12 and 13 a shown in FIG. 4. The inclination causes the side walls to be wedged or pressed together against each other into the corner of the connector and against the load or contents of te container. The angle of the flanges with respect to the corner has been shown in somewhat exaggerated form in the drawings, in order to better illustrate the principle involved.

Figure 5:
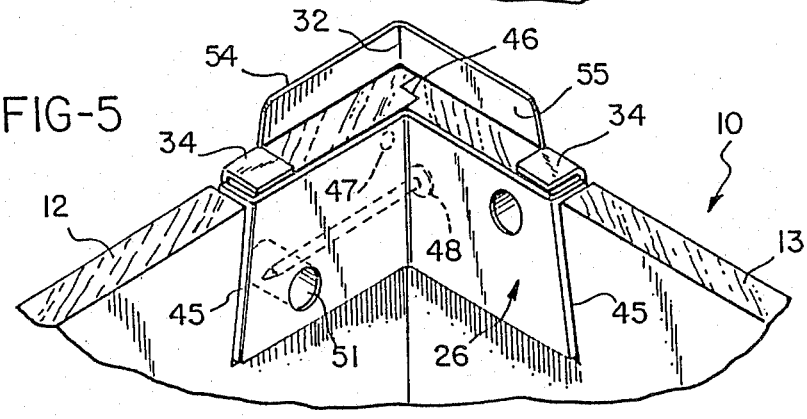
FIG. 5 shows the relationship of the parts of FIG. 4 after the corner connector has been assembled in relation to the intersecting side walls.
Figure 6:
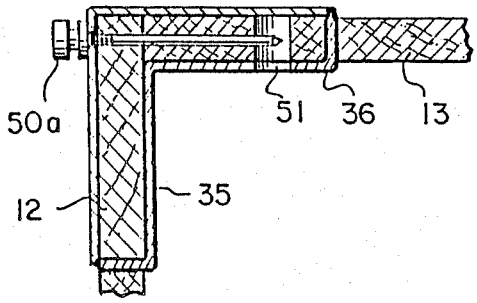
FIG. 6 is a sectional view through the corner connector and side walls looking generally along the line 6—6 of FIG. 7.
Figure 21:
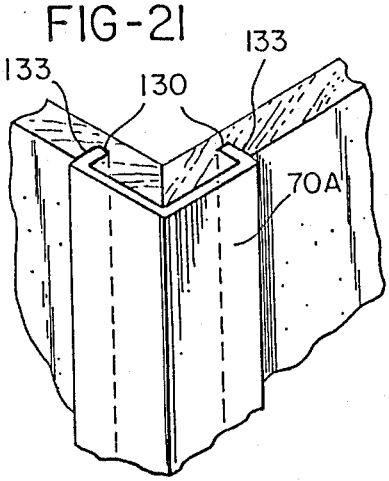
FIG. 21 is an enlarged fragmentary perspective of the corner protector of FIG. 20.

The intersecting walls thus joined and supported by the connector 25 may be formed square, or the ends may be beveled so that they join along a line in common with the corner 32 of the connector 20. A lap joint 46 as shown in FIGS. 4 and 5. A preferred bevel joint is shown in FIG. 21. A square or butt joint is shown in FIG. 6. When the connector is inserted into position, the upper tabs 33 come to rest against the respective upper surfaces of the intersecting side walls 12 and 13, immediately inwardly of the side cuts 45, and the side panels are pulled together by the flanges 34 or 40. As noted above, if desired for savings of expense and simplicity, the inner member 26 may be omitted from the connector 20, since the walls 12 and 13 cannot in any case move inwardly by reason of the junction of the walls at the corners and by reason of the loading or content of materials on the interior of the container.

Figure 7:
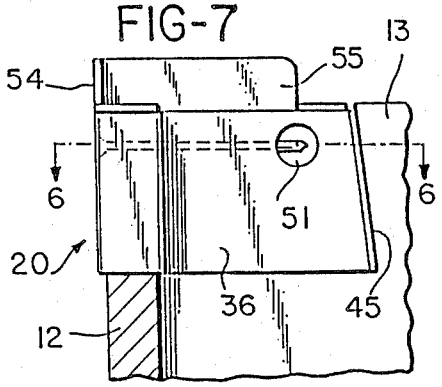
FIG. 7 is an inside elevational view of the connector of FIG. 6.

The outer member 30 may also be provided with a pair of staggered fastener openings 47 and 48, just outwardly of the corner 32, for the purpose of receiving a nail, a screw, or the like. A typical nail 50 is shown in FIG. 4, and when it is driven in, it will secure the corner connector in place. If desired, a finishing nail may be used in which the head will become recessed in the opening 47 or 48 and thereafter be exceedingly difficult, if not impossible, to remove without damaging or destroying the connector. In this case, an access opening 51 may be provided in the inner member 26 in alignment with the nail, as shown in FIGS. 5 and 7, through which long nose pliers may be inserted to assist in removing the nail if it becomes necessary to disassemble the container. In order to facilitate the removal of the fastener where desired, a double headed or duplex nail **50*a* may be used, as shown in FIG. 6. FIG. 6 also shows how the fastener is guided between the inside and outside members of the connector, and cannot puncture through to the outside or inside surface of the container to form a "shiner." If desired, one or more of the openings 47 or 48** may be enlarged to receive a movable cylinder fastener. Such tumbler or cylinder fasteners permit key access by permitting ease of removal of one or more of the connectors.

When the corner connector is in place, upwardly extending flange corner portions 54 and 55, formed as an interal part of the legs 30 and 31, extend above the side walls and are joined at the corner 32. The legs locate and receive a top or a bottom of the container, as the case may be, and have a height which does not exceed the thickness of the top or bottom.

Figure 8:
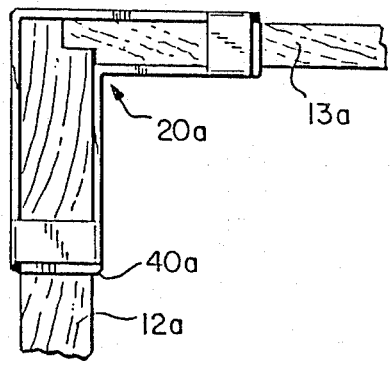
FIG. 8 is an elevational view of a modified corner connector according to this invention, specifically adapted to engage side walls and end walls of differing thicknesses.

In some instances, it may be desirable to provide a knock-down storage or shipping container in which one of the side walls or end walls is formed of thicker or heavier material than the adjacent wall. Such a condition is illustrated in FIG. 8 in which the side wall **12*a* is formed of material which is substantially thicker than the intersecting side wall or end wall 13*a*. The connector 20 may be modified as shown by the connector 20*a* in FIG. 8, in which the outer member 25 is identical to that shown in FIG. 2. However, the spacing to accommodate the wider wall 12*a* is readily accomplished by lengthening one of the outwardly turned flanges, as shown by the flange 40*a* in FIG. 8. Again, the longer flange 40*a*** would be also set at a slight incline or an angle to the corner, to cause a camming or pulling together of the adjoining walls when the connector is inserted over the corner.

Figure 9:
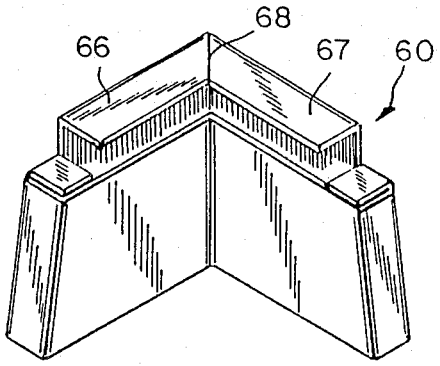
FIG. 9 is a perspective view of another modified corner connector according to this invention.
Figure 10:
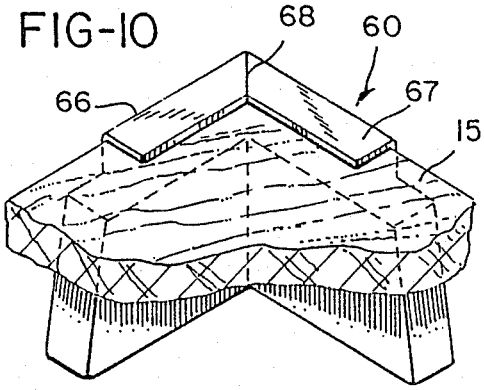
FIG. 10 is a view of the connector of FIG. 9 showing the lid in place.

In some instances, a modified form of the connector may be made as illustrated at 60 in FIGS. 9 and 10. The connector 60 differs from the connector 20 primarily in that the planar leg sections 30 and 31 of the outer member 25 are terminated at inwardly turned top ends 66 and 67 joined along a common welded seam 68, to capture and retain the adjacent corner of a lid or bottom panel, as shown in FIG. 10. The modified form of the connector 60 may be preferred for use as bottom brackets, or for two of the top corner connectors as shown in the embodiment of FIGS. 9 and 10, to support a cover with the remaining connectors being of the type shown in FIG. 4.

Figure 11:
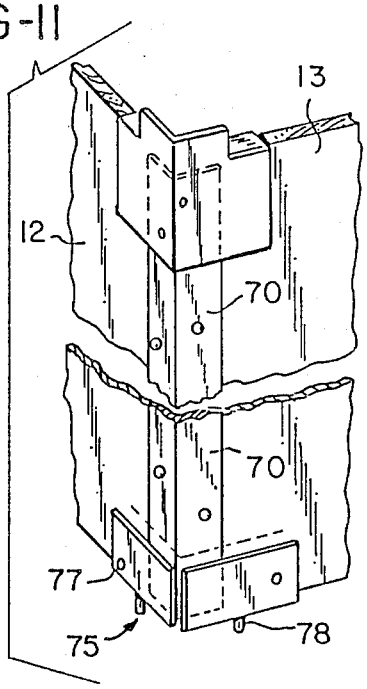
FIG. 11 is a fragmentary perspective view of the security container showing an arrangement for capturing a corner protector between top and bottom connectors along one of the container corners.
Figure 13:
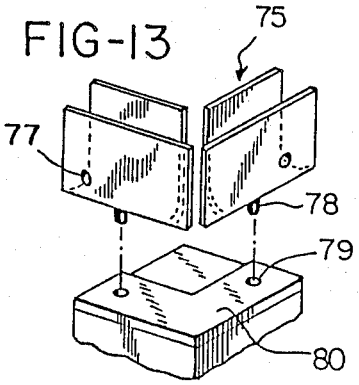
FIG. 13 illustrates a modified form of a pair of bottom brackets with locating pins, particularly adapted for supporting a container on a pallet.

In some instances it may be desirable to provide security as well as damage protection for the corners of the container. This may be accomplished by inserting an angle member 70, as shown in FIG. 11, between the upper and lower connectors, with the angle member emcompassing and covering the exposed corner and with the upper and lower ends captured between the corner connector 20 and the adjacent outer surface of the insecting panels. FIGS. 11 and 13 also illustrate a modified form of lower corner connectors 75 which are adapted particularly to support a container on a pallet. In this instance, the lower corner connectors may consist of generally U-shaped sleeves received as saddles over each of the intersecting walls at the corner, which saddles may be retained by a single rivet 77. The connector 75 supports a downwardly extending pin 78. The pin 78 may be received in a suitable aperture 79 formed in a bottom plate 80. The bottom plate 80 may be attached or form a part of a pallet.

Figure 12:
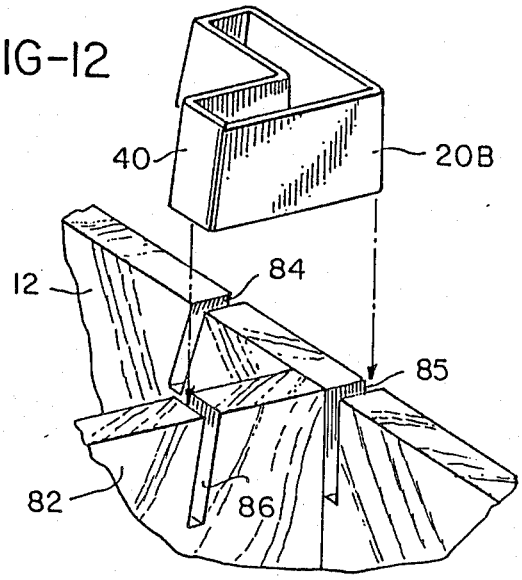
FIG. 12 is an exploded perspective view of a modified connector according to this invention used for supporting partitions in relation to one of the side or end walls.

FIG. 12 illustrates the manner in which a connector **20*b* may be utilized for supporting a partition, such as a partition 82, which extends transversely of the interior of the container between the side walls. The connector 20*b* omits the upper tabs 34 and the corner flanges 54 and 55. The side wall 12 is formed with an inclined cut 84 and and a straight cut 85 to receive the connector 20*b*. The petition is also formed with an inclined cut 86 to receive the connector flange 40**.

Figure 16:
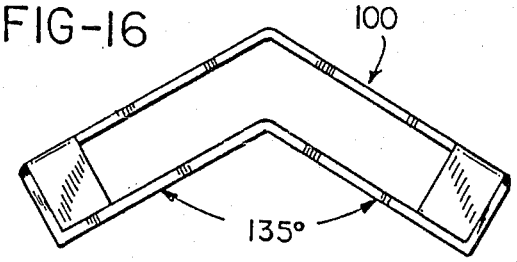
FIG. 16 is a plan view of a corner connector to secure container walls at an angle of 135°.

The fastening connectors of this invention are also useful in making up containers of special shapes where the intersecting walls will be less than or greater than 90°. For example, the included angle for the outer and inner members as shown in FIGS. 2 and 3, respectively, may be formed at 60°, rather than 90°, for supporting the walls of a triangularly shaped container. Likewise, the included angle may be greater than 90°, such as 135° as illustrated by the modified connector 100 as shown in FIG. 16 to form an octagonal container.

Figure 17:
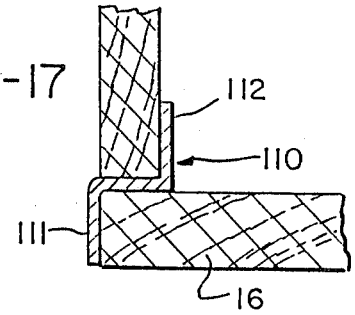
FIG. 17 is a transverse sectional view through a side wall and a bottom or top member showing a preferred reinforcing rail for strengthening the top and bottom of the container.
Figure 20:
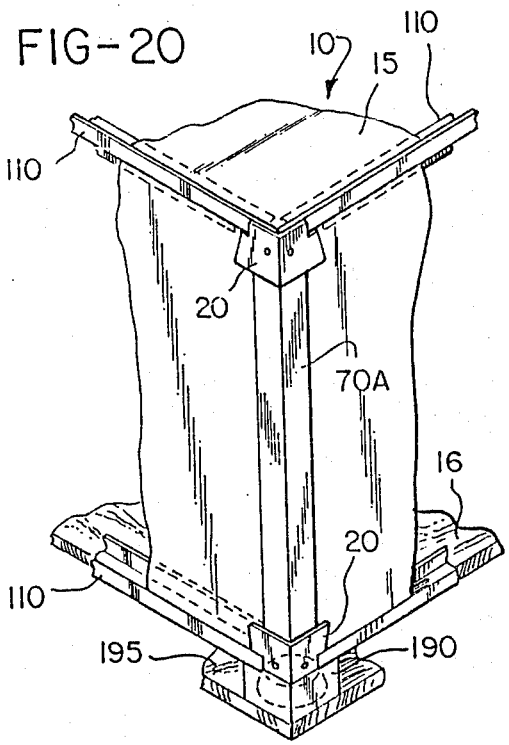
FIG. 20 is a fragmentary view of a panel corner showing a modified form of corner protector and showing top and bottom reinforcing rails.

It may be desirable to reinforce and strengthen the container along the top and bottom edges and to provide metallic reinforcement along these edges. This is particularly helpful in the palletized version of the container as a pallet bin as shown in FIGS. 1 and 20, in which forklift trucks may be inserted under the container, from varying directions. The preferred reinforcing rail is illustrated generally at 110 in FIGS. 17 and 20 as having an outer leg 111 which extends outwardly of the container and encloses the respective edge of the top or bottom panel and as having an inner leg 112 which extends upwardly along the inside wall. The general S-shape of the rail 110 provides for substantial strength along the margins of the top and bottom of the container, so that a plurality of the containers may be stacked one on top of the other without fear of crushing. Further, the exposed outer metal surfaces defined by the flange 110s protect the edges of the container from damage due to contact with the lifting forks of a forklift truck or due to contact with other elements, and resist outside forces tending to push in the sides.

Figure 18:
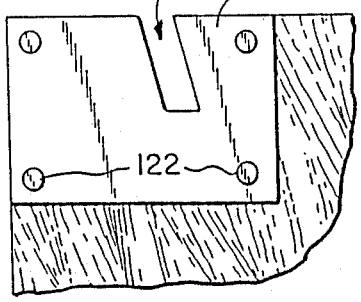
FIG. 18 is a fragmentary view of a corner reinforcement of a panel.

It may be necessary to strengthen or reinforce the corners of one of the side wall panels 12 or 13 or to repair a panel in which a corner has been broken out. For this purpose, a reinforcing plate 120 (FIG. 18) may be provided at the corner of the panel, on the outer surface, and held in place by one or more rivets 122. The reinforcing plae 120 is provided with a tapered notch 124, for receiving the connector flange 34 or 40, and serves the same purpose as the notch 45 described above in connection with FIGS. 4 and 5.

Figure 19:
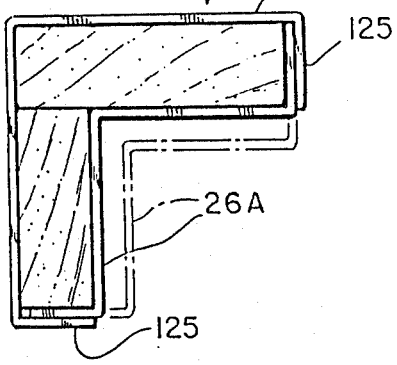
FIG. 19 is a plan view of a modified corner connector showing the manner in which a two-piece connector may be formed from common bending apparatus to provide elements which can accommodate different widths of side walls.

FIG. 19 illustrates the manner in which a corner connector may be made according to this invention using inside and outside sheet or strap material of a fixed dimension, for providing corner connectors which accommodate different widths of material. The modified connector 20*a* in FIG. 19 is formed with an outer generally channel shaped member 30*a* with inwardly turned ends 125, which ends overlap inwardly turned ends 126 formed on an inside optional member 26*a*. The spacing between the members 20*a* and 26*a* may be varied merely by changing the extent of overlap between the flanges 125 and 126, to permit the inside member 26*a* to be spaced a greater distance from the outside member as illustrated by the phantom lines. The members may be welded together at the overlap by suitable spot welding. Thus, the inside member 26*a* may be formed from the same width material, originally, with the ends 126 formed to accommodate different widths of materials with correspondingly differing overlaps along the marginal edges.

FIGS. 20 and 21 illustrate a modified form of corner protector 70*a*. The corner protector 70*a* differs from the corner protector 70 as shown in FIG. 11 in that it is formed with terminal ends 130 and 132 along the vertical marginal edges which are inwardly turned and received in corresponding grooves 133 formed in the respective side panels. The edge protector 70*a* may be preferred over the protector 70 when more secure and permanent protection is desired.

Figure 22:
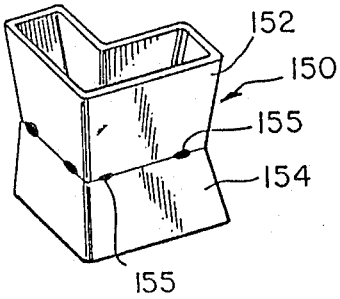
FIG. 22 is a perspective view of an intermediate connector element according to the invention for stacking of side walls in building up containers of various sizes.
Figure 23:
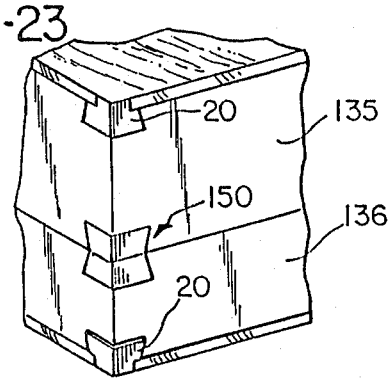
FIG. 23 is a fragmentary perspective view showing the manner of using the stacking connector of FIG. 22.

FIGS. 22 and 23 illustrate the modular concept of the invention in which side and end walls are formed of standard width materials and are stacked, as desired, to form a container made up of narrower wall panels, such as the wall panels 135 and 136. For this purpose, a stacking connector as illustrated in 150 may be used. The stacking connector is in effect two of the connectors 20*b* as illustrated in FIG. 12, welded in inverted relation to each other, thereby forming an upper connector section 152 and a lower connector section 154, each of which connector sections receive the respective interfitting corners of the panel sections 135 and 136, with the inclined marginal edges received within suitably formed slots, as previously described. The connector sections 152 and 154 making up the connector 150 may be spot-welded together as illustrated by the welds 155 to form a unitary stacking connector by which pairs of side and end panels may be joined together in making up containers to a desired capacity.

Figure 14:
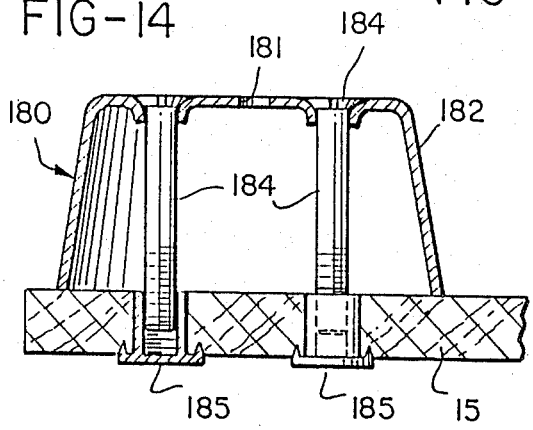
FIG. 14 is a tranverse sectional view through one of the locator elements as secured to the box lid or cover.
Figure 15:
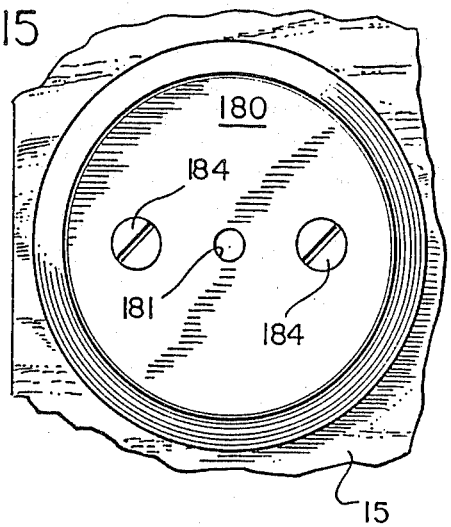
FIG. 15 is an elevational view of the locator element of FIG. 14.

As previously mentioned, this invention has particular utility in the containerized handling of parts and the like in which the completed bins are self-palletizing and adapted for stacking and movement on conventional forklift trucks with eight-way entry. The arrangement of this invention eliminates the need for separate wooden pallets and assures alignment of the individual containers to each other and prevents slipping of the containers. The top 15 of the container, as perhaps best illustrated in FIG. 1, may be provided with inverted round tapered metallic locators 180 as shown in FIGS. 14 and 15. The locator 180 may be spun from sheet metal and provided with a generally flat top 181 and outwardly tapered sides 182, and permanently retained by sheet metal screws 184 received in T-nuts 185 through the bottom of the top or bottom panel. The locators 180 may be positioned at the four top corners. They are particularly designed so as to have a nominal height somewhat less than two inches and a nominal width somewhat less than four inches, to be readily received within, and cooperate and interfit within rectangular base footers or metal sleeves 190 which are formed in depending relation from the container bottom, at corresponding locations.

The footers 190 may be formed of rectangular four inch portions of 4″×4″ square metal tubing, provided with a welded base plate and bolted to the bottom of the container. The footers 190 each define a central downwardly facing opening within which may be received over one of the locators 180. It may also be desirable to support the bottom of a container on a locating base 195, as shown in FIG. 1, and for this purpose, the locating base 195 may also be provided with the locators 180 in the same manner as previously described in connection with the container top 15.

It will accordingly be seen that a highly versatile system of containing, shipping and storing is provided by this invention, in which the intersecting walls are firmly locked together in place by sheet metal corner connectors. The connectors, and the corner and edge protectors provide a high degree of security in a reusable container.

Conventionally, the completed container 10 may be loaded from the top prior to the installation of the lid or top wall 15, and the securing of one or more encircling metal straps 22.

The embodiment of the connector is shown at 60 in FIGS. 9 and 10 may be a preferred connector to use for the botom corners of the container and may conveniently be used for three out of four of the top corners, permitting the lid 15 to be slid in place, as shown in FIG. 10, under the inwardly turned top ends 66 and 67.

Either the corner connector 20 or 60 may be used as the upper connectors in an end-filling arrangement, in which one side wall or end wall is put into place only after the container has been filled through the associated open side or end. In this event, the end wall involved will be lifted up into place into the open leg of the associated corner fastener, and the bottom portion preferably retained by the generally U-shaped clips or connectors 75 as shown in FIGS. 11 and 13. Also, while the terms "top" and "side" have been used in their conventional sense, it should be understood that the container formed in accordance with this invention may be oriented in other positions in which one side actually becomes a top and in which the top and/or bottom become sides, without departing from the scope of the invention.

It is further understood that an assembly or loading jig may be readily devised for supporting the container of this invention for erection and for loading. For this purpose, a base member 195 may be used or a portion of such a base member may be used, as required or as convenient, for providing location and support for the end and side wall panels.

Thus, a base member 195 may provide location and support for three side walls while the fourth side wall is open to permit side loading, and thereafter the fourth side may be added and the corner connectors inserted.

For example, a container constructed according to this invention may be designed to receive and transport 770 quart cans of oil for shipment and/or storage. Such a container would be 45¾" wide, 41½" deep, and 39¾" high, and when loaded would weight approximately 1,500 pounds. The container or bin may be conveniently shipped in a knocked-down condition in which the side panels and top panels are mounted and straped to the base or bottom panel, and the individual connectors to be used may be conveniently nested within one of the 4"×4" square metal tubing footers 190 for subsequent use in erecting the bin.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A corner connector for seouring and retaining the side walls and end walls of a container, comprising:

a sheet metal member having first and second angled, generally planar legs proportioned to abut the adajcent intersecting outer surfaces of said walls and joined to each other along a common corner, each of said legs having a generally transversely extending tab proportioned to engage the adjacent upper surface of one of said walls and defining the seated position of said connector on said walls, and each of said legs terminating in a flange extending generally normal to the associated said leg along the marginal edge of said leg and adapted to be received in accommodating slots formed in said walls when said tabs are positioned against an upper surface of said walls, said flanges each being formed at an inclination to said common corner so that said connector is wider at the bottom than at the top and causes a coming together of the intersecting walls of a container.

2. The connector of claim 1 in which said legs have upper flange portions adapted to extend above the container side walls to receive the corner of a lid therein.

3. A corner connector for securing and retaining the side walls and end walls of a container, comprising:

an outer sheet metal member having first and second angled, generally planar vertical legs proportioned to abut the adjacent intersecting outer surfaces of said walls and joined to each other at common vertical corners, an inner sheet metal member having first and second generally planar angled legs joined along a common corner; and edge flanges formed at an inclination to said corners joining said members together with said respective member legs spaced apart from each oter and adapted to be received therebetween one of said walls when said flanges are received in accommodating tapered slots formed in said walls.

4. The connector of claim 3 in which said outer member legs have upper flange portions extending above the container side walls and adapted to receive the corner of a lid therein.

5. The connector of claim 3 in which each of said connctor members is formed with a pair of inclined edge flanges adapted to interfit with corresponding edge flanges of the other said member, and means joining said members at said respective interfitting edge flanges.

6. A corner connector for locating and retaining the intersecting end and side walls of a container, comprising:

spaced apart outer and inner sheet metal members, said outer member having first and second planar sections joined to each other along a common corner in an angled configuration corresponding to the included angle of the corner, said inner connector also having first and second generally planar sections joined to each other along a common corner in a corresponding angle, means on at least one of said members defining transversely extending tapered edges defining the spacing between said members, said edges being tapered with respect to said corners to define a wider space at the bottom of said connector than at the top thereof, and means joining said members at said edges.

7. The connector of claim 6 in which said planar sections define panel-receiving spaces which are of unequal width to accomodate an end panel of a container which has a width different than that of an interesting side panel.

8. The connector of claim 6 further comprising an aperture in each of said outer member planar sections adapted to receive an elongated locking device for extension into the butt end of one of the intersecting container wall panels.

9. The connector of claim 8 in which said device comprises a nail received in said aperture.

10. A corner connector for locating and retaining the intersecting end and side walls of a container, comprising:

outer and inner sheet metal members, said outer member having first and second planar sections joined to each other along a common corner in an angled configuration corresponding to the included angle of the corner, said inner member also having first and second generally planar sections joined to each other along a common corner in a corresponding angle and having opposite outwardly turned edges in abutment to the outer member sections to define a panel-receiving spaces between said planar sections, means joining said members at said edges, and at least one of said members further having transversely turned tabs which are positioned and engage the container walls at the tops thereof and define the seated position of the connector.

11. The connector of claim 10 further comprising an aperture in each of said outer member planar sections adapted to receive an elongated locking device for extension into the butt end of one of the intersecting container walls.

12. The connector of claim 10 in which said planar sections define panel-receiving spaces which are of unequal width to accommodate an end panel of a container which has a width different than that of an intersecting side panel.

13. In a security knock-down container having side walls, a bottom wall, and a top wall, said side walls being joined together at the corners thereof by sheet metal corner connectors, the improvement comprising:

each said corner connector having inner and outer members, each said members having horizontal planar sections joined along a vertical corner bend, means joining said members in spaced-apart relation with the spacing therebetween sufficient to accommodate a portion of one said container side walls therein, said joining means formed as a generally vertical flange integral to at least one of said members and joining with the other said member, and means in each of said side walls adjacent said corner defining a vertical slot receiving said flange therein, tab means on said connector engageable with a horizontal top surface of one said container side wall, and means on said connector for receiving an intersecting third wall, such as a conainer top or bottom wall, for positioning and locating the same with respect to said side walls.

14. An improved container system including corner connector elements permitting containers of varying sizes to be assembled on a site from pairs of container side walls of differing heights, the improvement comprising:

a double-ended connector at each of the corners of the container for joining the side wall pairs together in superimposed relation to each other, said connector having spaced inner and outer sheet metal members defining inside and outside corner wall-engaging legs joined along a common corner, edge flanges joining said members together in spaced relation, said flanges adapted to be received in slots formed in said side walls, said flanges being formed at a taper with respect to said corner to cause a camming together of the side walls into the corner when received in said connector.

15. The container of claim 14 in which said connectors are each formed in two identical sections, one associated with each of said side panels, and joined toether in superimposed relation to each other.

* * * * *